US010716397B2

(12) United States Patent
Garrett

(10) Patent No.: US 10,716,397 B2
(45) Date of Patent: Jul. 21, 2020

(54) GUN CABINET

(71) Applicant: Robert Garrett, Mooresville, NC (US)

(72) Inventor: Robert Garrett, Mooresville, NC (US)

( * ) Notice: Subject to any disclaimer, the term of this patent is extended or adjusted under 35 U.S.C. 154(b) by 0 days.

(21) Appl. No.: 16/128,943

(22) Filed: Sep. 12, 2018

(65) Prior Publication Data

US 2019/0104844 A1 Apr. 11, 2019

Related U.S. Application Data

(60) Provisional application No. 62/565,828, filed on Sep. 29, 2017.

(51) Int. Cl.

| | |
|---|---|
| ***A47B 81/00*** | (2006.01) |
| ***A47B 88/483*** | (2017.01) |
| ***A47B 46/00*** | (2006.01) |
| ***A47B 88/42*** | (2017.01) |
| ***A47B 88/41*** | (2017.01) |

(52) U.S. Cl.

CPC ..... *A47B 81/005* (2013.01); *A47B 46/00* (2013.01); *A47B 88/41* (2017.01); *A47B 88/42* (2017.01); *A47B 88/483* (2017.01); *A47B 2210/0059* (2013.01)

(58) Field of Classification Search

CPC ..... A47B 81/005; A47B 46/00; A47B 2210/0059; A47B 88/483; A47B 88/42; A47B 88/41

USPC ..... 211/64, 162, 175; 312/130, 132, 249.4, 312/249.8, 249.9, 249.11, 334.1, 334.5, 312/334.8, 334.14, 334.15

See application file for complete search history.

(56) References Cited

U.S. PATENT DOCUMENTS

| | | | | | |
|---|---|---|---|---|---|
| 415,058 | A | * | 11/1889 | Phillips | F25D 23/087 312/296 |
| 654,660 | A | * | 7/1900 | Markline | G06K 9/6255 312/198 |
| 1,202,588 | A | * | 10/1916 | Roberts | A47B 81/00 211/64 |
| 1,281,923 | A | * | 10/1918 | Fales | A47B 88/42 312/317.2 |
| 1,750,291 | A | * | 3/1930 | Whetstone | A47B 63/02 109/56 |
| 1,951,255 | A | * | 3/1934 | Parker | A47B 81/005 211/64 |
| D126,088 | S | * | 3/1941 | Clouse | 211/64 |
| D162,207 | S | * | 2/1951 | Mettenleiter | 211/64 |
| 2,660,506 | A | * | 11/1953 | Wright | A47B 53/00 206/564 |
| 2,769,676 | A | * | 11/1956 | Larsen | A47B 17/02 312/306 |
| 2,848,293 | A | * | 8/1958 | Jurgens | A47B 53/00 312/222 |
| 2,923,584 | A | * | 2/1960 | Broderick, Jr. | A47B 53/00 312/317.1 |

(Continued)

*Primary Examiner* — Jonathan Liu
*Assistant Examiner* — Devin K Barnett
(74) *Attorney, Agent, or Firm* — Ronald L. Hofer

(57) ABSTRACT

A gun cabinet has an opening door and an enclosure with a bottom wall having a slot. The enclosure contains a drawer which is supported on a caster wheel on an associated floor. The drawer is slidably attached to the enclosure so that the drawer can be pulled substantially out of the enclosure or rolled back into the enclosure with the caster wheel being received into the slot in the bottom wall of the enclosure.

7 Claims, 6 Drawing Sheets

(56) References Cited

U.S. PATENT DOCUMENTS 2,958,422 A * 11/1960 Caloiero ..... A47B 81/005 211/4
3,031,069 A * 4/1962 Hirsch ..... F41C 33/06 206/317
3,335,326 A * 8/1967 Bonin ..... H01R 35/02 174/69
3,664,163 A * 5/1972 Foote ..... E05B 73/0005 211/4
4,084,125 A * 4/1978 King ..... A47B 53/00 312/199
4,113,107 A * 9/1978 Jaeger ..... A47B 81/005 211/4
4,132,315 A * 1/1979 Young ..... E05B 73/00 211/4
4,314,733 A * 2/1982 Smith ..... A47B 88/42 211/50
4,436,352 A * 3/1984 Okada ..... A47B 77/16 312/228
D283,571 S * 4/1986 Champion ..... D6/661
4,621,876 A * 11/1986 Reimer ..... A47B 88/487 312/330.1
4,714,305 A * 12/1987 Service ..... A47B 77/16 211/74
5,468,063 A * 11/1995 Simonek ..... A47B 88/42 312/287
5,597,219 A * 1/1997 Horn ..... A24C 5/352 211/10
5,626,379 A * 5/1997 Scott ..... A47B 81/005 211/195
5,772,295 A * 6/1998 Sundmark ..... A47B 46/005 312/242
5,924,779 A * 7/1999 Krumholz ..... A47B 88/42 211/151
6,595,606 B1 * 7/2003 Gunst ..... G07F 19/20 109/24.1
6,688,708 B1 * 2/2004 Janson ..... A47B 53/02 312/200
6,719,384 B1 * 4/2004 Parise ..... B25H 3/00 312/249.9
7,131,543 B2 * 11/2006 Mason ..... A47F 5/0018 211/59.2
D636,599 S * 4/2011 Hsu ..... D3/297
8,109,581 B1 * 2/2012 Lazenby ..... A47B 88/90 312/311
9,192,231 B1 * 11/2015 Steffen ..... A47B 81/005
9,730,517 B2 * 8/2017 Youngs ..... A47B 96/04
9,788,653 B1 * 10/2017 Lazenby ..... A47B 77/16
9,962,020 B2 * 5/2018 Young ..... A47B 81/00
D839,526 S * 1/2019 Stauffer ..... D34/28
2003/0205955 A1 * 11/2003 Egger ..... A47B 88/43 312/334.5
2004/0045914 A1 * 3/2004 Sells ..... A47B 49/00 211/4
2004/0140280 A1 * 7/2004 Cleveland ..... A47B 46/00 211/64
2005/0035696 A1 * 2/2005 Parise ..... A47B 31/00 312/249.9
2005/0115912 A1 * 6/2005 Szuminski ..... A47B 81/005 211/64
2005/0133473 A1 * 6/2005 Lesperance ..... A47B 81/005 211/64
2005/0194872 A1 * 9/2005 Cleveland ..... A47B 81/005 312/290
2005/0200251 A1 * 9/2005 Stone, III ..... A47B 46/00 312/351.1
2006/0163984 A1 * 7/2006 Andersen ..... A47F 3/0486 312/401
2006/0250056 A1 * 11/2006 Fitzgerald ..... A47F 3/02 312/249.9
2006/0283820 A1 * 12/2006 Peters ..... A47B 81/005 211/64
2007/0013478 A1 * 1/2007 Crigger ..... A47B 81/005 340/5.53
2007/0024165 A1 * 2/2007 Moulton ..... A47B 81/005 312/291
2007/0035219 A1 * 2/2007 Andersen ..... A47F 3/0486 312/249.9
2007/0145869 A1 * 6/2007 Sjolander ..... A47F 3/0469 312/249.8
2008/0252414 A1 * 10/2008 Crigger ..... G07C 9/00158 340/5.52
2008/0296331 A1 * 12/2008 Klosk ..... B60R 7/02 224/547
2008/0309209 A1 * 12/2008 McFarland ..... A47F 5/11 312/249.8
2009/0078661 A1 * 3/2009 Kinsella ..... A47B 81/005 211/64
2011/0168649 A1 * 7/2011 Stolz ..... A47B 81/005 211/4
2012/0001529 A1 * 1/2012 Rahilly ..... A47B 61/02 312/334.1
2013/0002116 A1 * 1/2013 Lodge ..... A47B 81/00 312/351.1
2014/0375197 A1 * 12/2014 Hilldebrand-Prinz ..... A47B 88/42 312/334.1
2015/0296982 A1 * 10/2015 Chen ..... A47B 88/43 312/334.8
2016/0088937 A1 * 3/2016 Moayeri ..... A47B 81/005 312/305
2016/0095432 A1 * 4/2016 Wirthlin ..... F41C 33/06 312/321.5
2016/0128474 A1 * 5/2016 Chen ..... A47B 88/956 312/333
2016/0157385 A1 * 6/2016 Chan ..... H05K 7/1497 312/236
2019/0011222 A1 * 1/2019 Suggs ..... F41C 33/06
2019/0063871 A1 * 2/2019 Cain ..... F41C 33/06

* cited by examiner

GUN CABINET

FIELD OF THE INVENTION

The present invention relates to gun cabinets for storing portable firearms such as long guns, for example, rifles and shotguns and handguns, for example, pistols and revolvers. More particularly, a preferred embodiment of the present invention relates to a gun cabinet having a tall drawer with a wheel for supporting the drawer on a floor supporting the gun cabinet. Another preferred embodiment has shelves located in an open space located between a pair of tall drawers.

BACKGROUND OF THE INVENTION

Gun cabinets range in design from simple, inexpensive homemade designs to complex, expensive commercial designs. There remains, however, room for improvements in gun cabinet designs. For example, gun cabinets commonly support rifles and shotguns on the floor of the cabinet which is fixedly secured to the cabinet walls. This arrangement makes it difficult to remove a gun from the cabinet especially when several guns are stored in the cabinet and the gun must be taken out past the other guns. It is awkward and problematic to remove a gun from a typical gun cabinet without scratching or otherwise damaging the gun or one of the other guns in the cabinet. It is also awkward and problematic to put a gun into a typical gun cabinet without scratching or otherwise damaging the gun or one of the other guns in the cabinet It would be desirable if a gun cabinet were able to hold and support guns in a fashion which facilitated their insertion and removal from the cabinet. It would also be desirable if a gun cabinet were to efficiently use its interior space for storage of guns while facilitating their easy insertion and removal. Accordingly, the present invention is directed to an improved gun cabinet which is designed to facilitate insertion and removal of guns into and out of the cabinet while also efficiently using the storage space inside the cabinet.

Thus, the present invention is directed to a gun cabinet having a base with one or more notches to accommodate at least one caster which supports a tall drawer on an associated floor. The drawer can be easily pulled forward from the cabinet to facilitate removal of guns from the cabinet. In a preferred embodiment of the present invention, a pair of tall drawers each have a foot portion and an opening with respective openings facing each other. Storage shelves are located in between the tall drawers for storage of ammunition, shooting accessories, handguns and the like.

Further understanding of the present invention will be had from the following description and claims taken in conjunction with the accompanying drawings.

SUMMARY OF THE INVENTION

Figure 2:
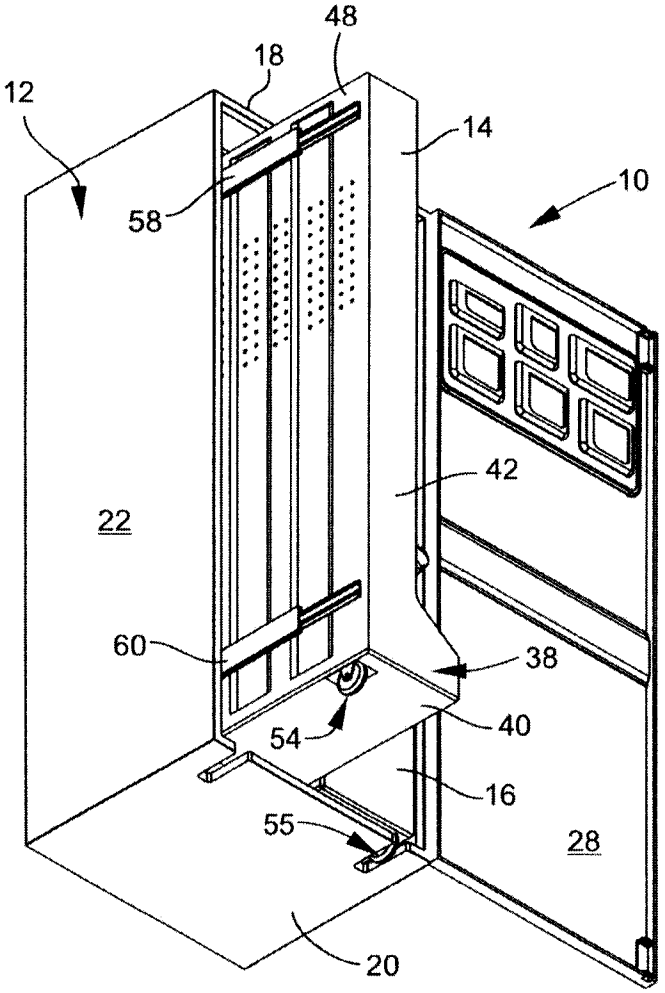
FIG. 2 is a perspective view from a bottom left viewpoint of the gun cabinet of FIG. 1 with its door in an open position and its left drawer pulled forward.
Figure 1:
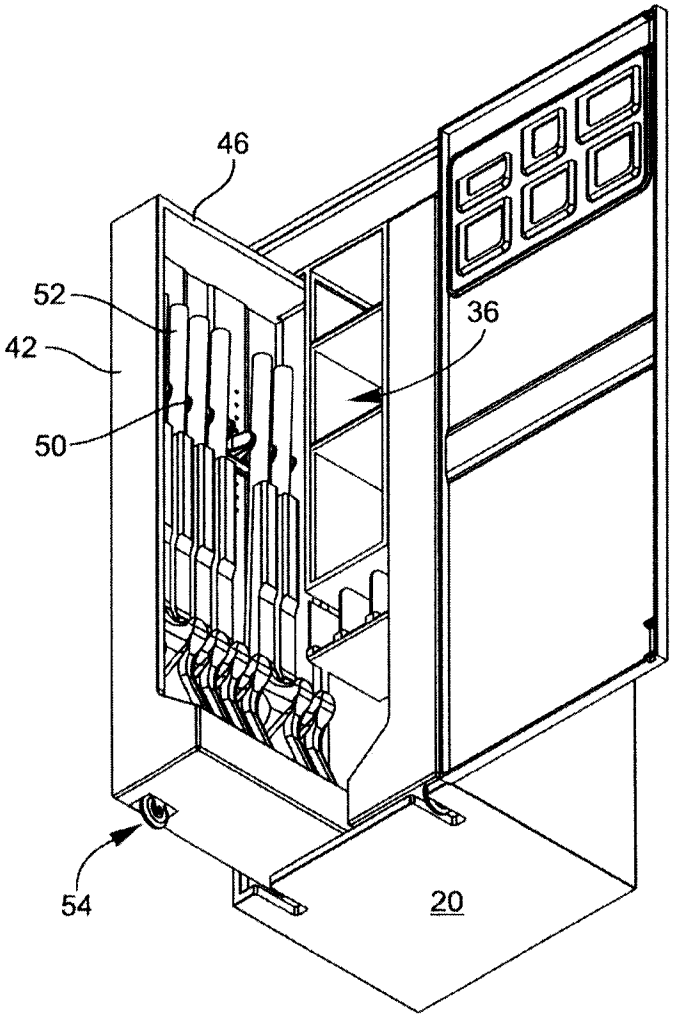
FIG. 1 is a perspective view from a bottom right viewpoint of a preferred embodiment of a gun cabinet of the present invention with its door in an open position and its left drawer pulled forward.
Figure 4:
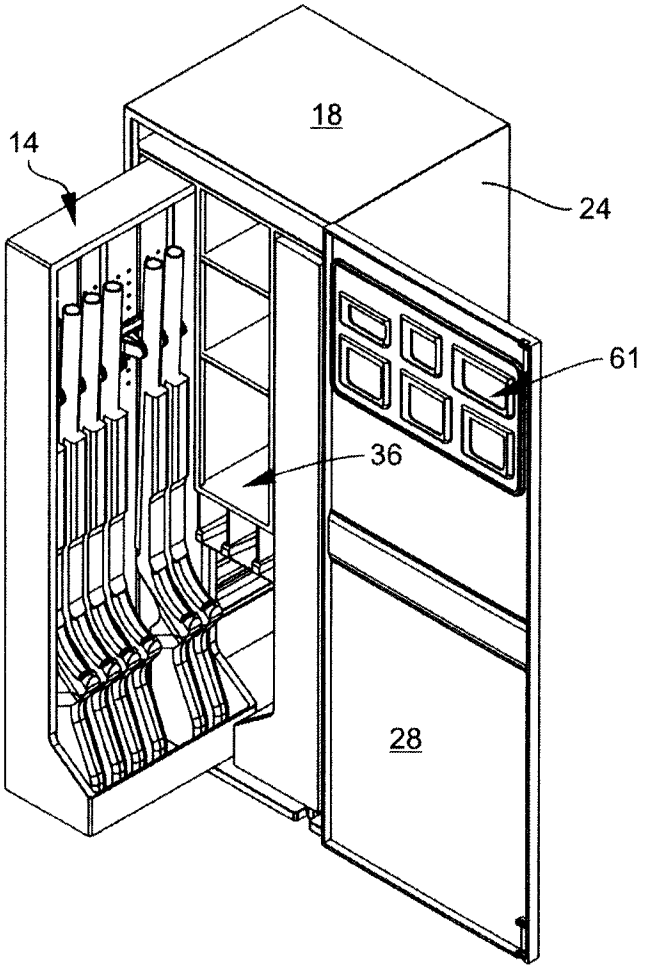
FIG. 4 is a perspective view from a top right viewpoint of the gun cabinet of FIG. 1 with its door in an open position and its left drawer pulled forward.
Figure 3:
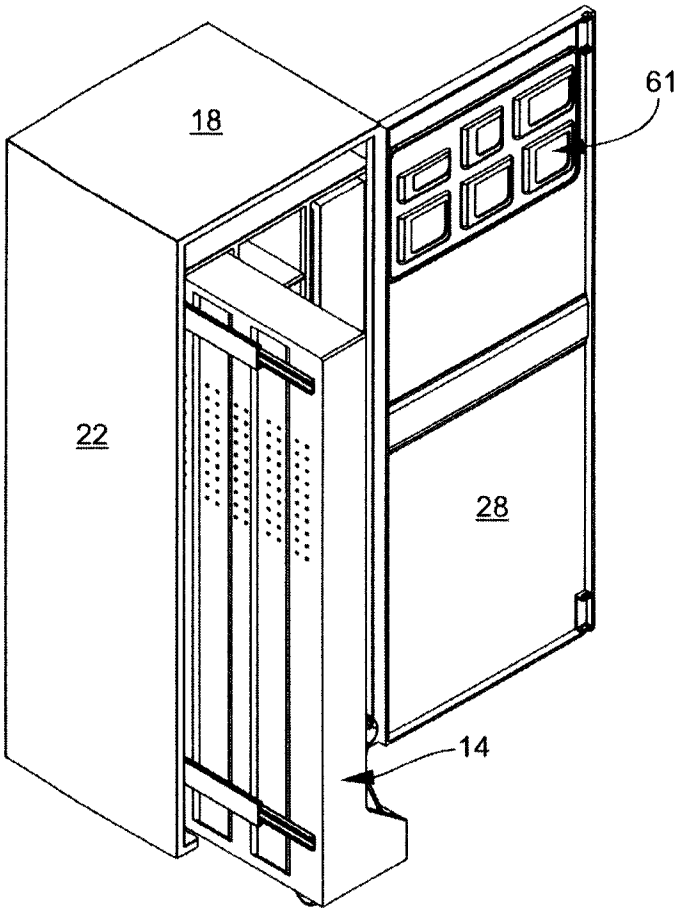
FIG. 3 is a perspective view from a top left viewpoint of the gun cabinet of FIG. 1 with its door in an open position and its left drawer pulled forward.
Figure 7:
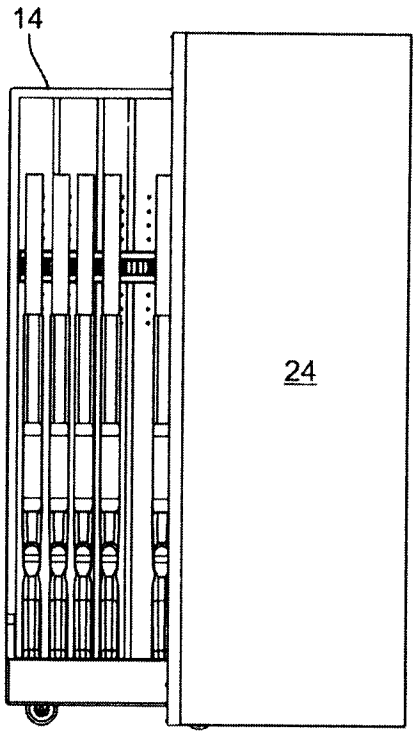
FIG. 7 is a right side elevation of the gun cabinet of FIG. 1 with its door in an open position and its left drawer pulled forward.

A gun cabinet has at least one sliding drawer positioned within an enclosure having a door and a bottom wall with a slot therein. Each drawer is supported on a caster wheel on an associated floor. The drawer is slidably attached to the enclosure so that the drawer can be pulled substantially out of the enclosure or rolled back into the enclosure with the caster wheel being received into the slot in the bottom wall of the enclosure. The gun cabinet preferably has a pair of drawers with feet, each drawer being a mirror image of the other, and each drawer having an open face in opposing relationship to the open face of the other drawer thereby defining an opening for shelves or the like.

DESCRIPTION OF THE INVENTION

Now referring to the Figures, a preferred embodiment of a gun cabinet of the present invention is shown and indicated generally by the numeral 10. Broadly speaking, gun cabinet 10 has an external enclosure 12 and a pair of tall drawers 14 and 16. Gun cabinet 10 can be used to store rifles, shotguns, handguns and the like.

External enclosure 12 is a structure with walls and a door shown in the Figures as top 18, bottom 20, sides 22 and 24, back 26, and door 28 defining a hollow interior space 30. External enclosure 12 is well illustrated in FIGS. 8-11 which show enclosure 12 with door 28 removed for illustrative purposes. Each wall and door of enclosure 12 can be made of steel or other suitable material with adjacent edges of the walls welded or otherwise secured together to provide a structurally sound enclosure. Each wall and door may, for example, comprise a pair of parallel panels with edges welded together. Bottom wall 20 has a pair of elongated slots 32 and 34 therein. Door 28 is pivotally attached to side wall 24 by hinges or the like (not shown in the Figures) to allow access to interior space 30 from outside of external enclosure 12.

A shelf structure 36 is secured within enclosure 12 to provide storage for gun accessories or ammunition or hand guns.

A pair of tall drawers 14 and 16 are slidably disposed within enclosure 12. Now referring to drawer 14, but it is to be understood that drawer 16 is analogous to, but the mirror image of, drawer 14, drawer 14 has a foot 38 with front wall 39, bottom 40 and tall, vertically extending sidewalls 42 and 44. Drawer 14 also has top 46 and back wall 48. Front wall 39 is a short wall leaving an opening above itself for insertion and removal of long guns from tall drawer 14. A plurality of dividers 50 are mounted on back wall 48 to separate guns 52 from each other. Caster 54 with wheel 56 is secured onto bottom 40.

Drawer glides 58 and 60 are attached between back wall 48 of drawer 14 and sidewall 22 of enclosure 12. Glides 58 and 60 allow drawer 14 to be pulled in and out of enclosure 12 with drawer 14 being also supported on an associated floor (not shown in the figures) by castor 54. Thus, the weight of guns 52 and drawer 14 is largely supported by castor 54 which facilitates movement of drawer 14 in and out of enclosure 12. As a result, drawer 14 can be easily pulled out of interior space 30 to allow easy access for removal or placement of each gun 52 onto drawer 14.

Figure 6:
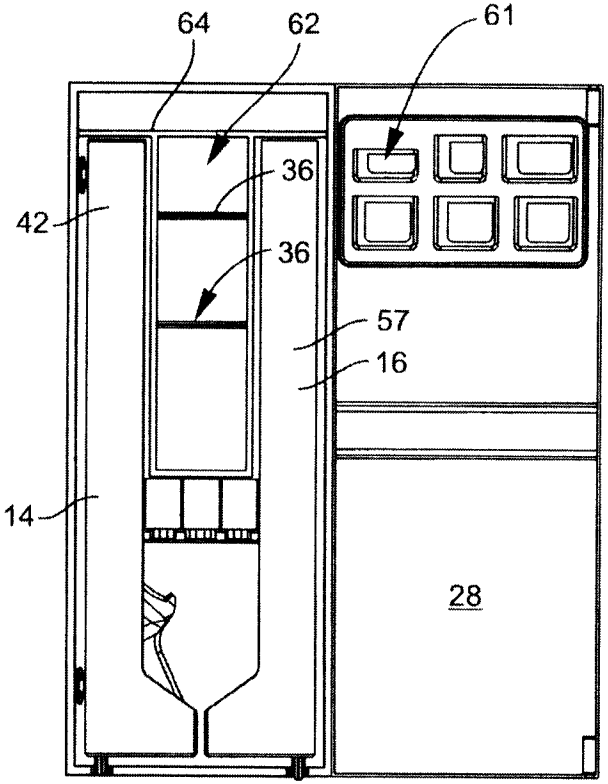
FIG. 6 is a front elevation of the gun cabinet of FIG. 1 with its door in an open position.
Figure 5:
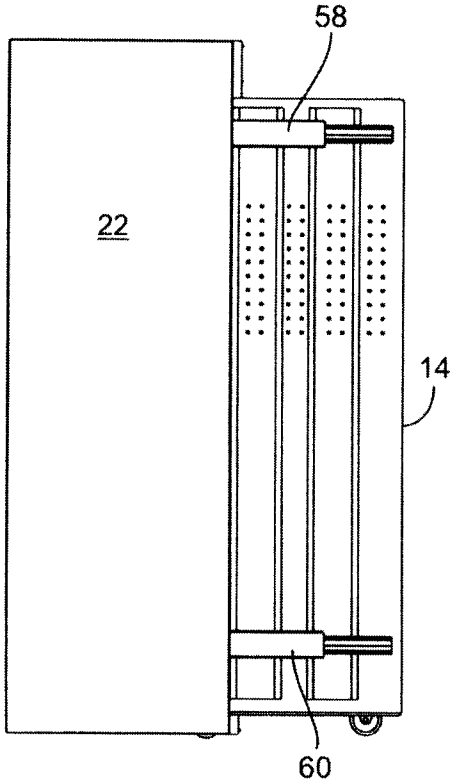
FIG. 5 is a left side elevation of the gun cabinet of FIG. 1 with its door in an open position and its left drawer pulled forward.
Figure 11:
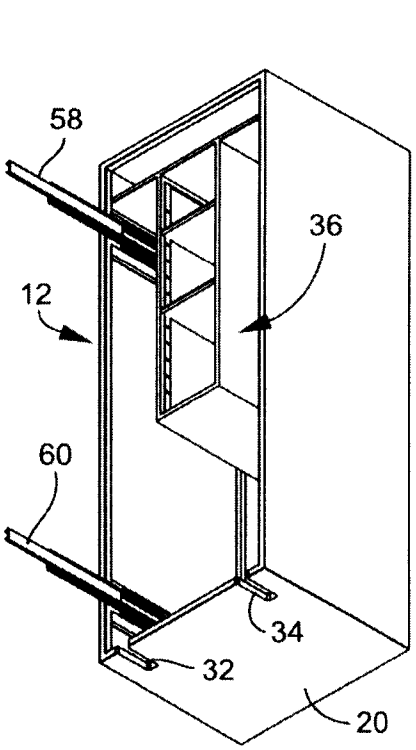
FIG. 11 is a perspective view from a bottom right viewpoint of the base cabinet of FIG. 8.
Figure 10:
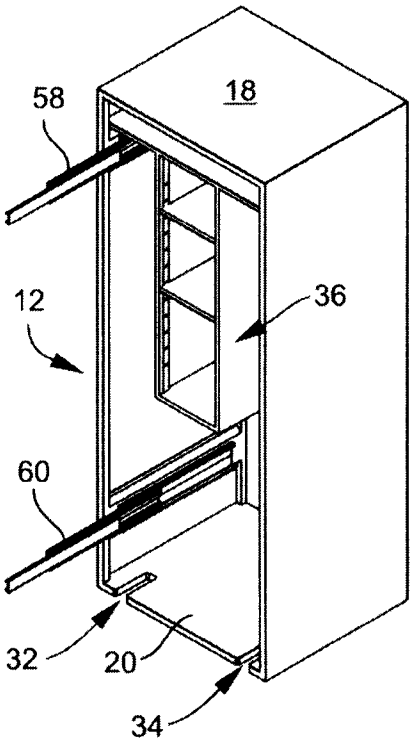
FIG. 10 is perspective view from a top right viewpoint of the base cabinet of FIG. 8.
Figure 9:
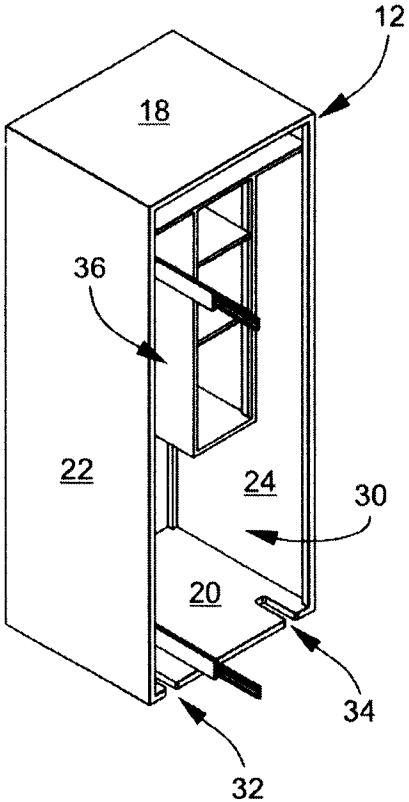
FIG. 9 is a perspective view from a top left viewpoint of the base cabinet of FIG. 8.
Figure 8:
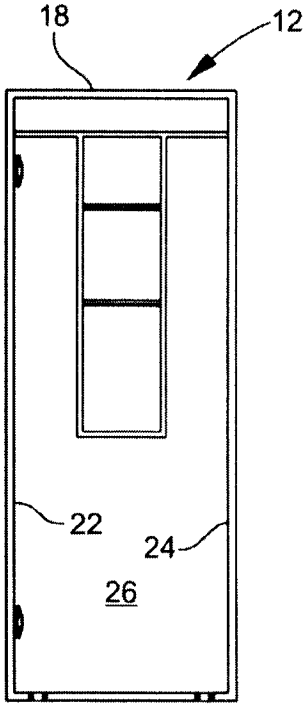
FIG. 8 is a front elevation of the base cabinet of the gun cabinet of FIG. 1 with its door, left drawer and right drawer removed.
Figure 13:
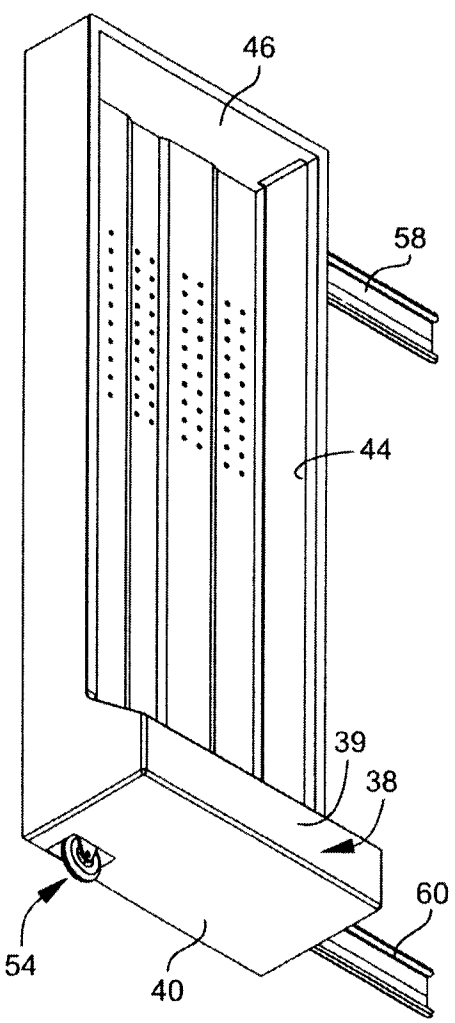
FIG. 13 is a perspective view from a bottom right viewpoint of the left drawer of the gun cabinet of FIG. 1.
Figure 12:
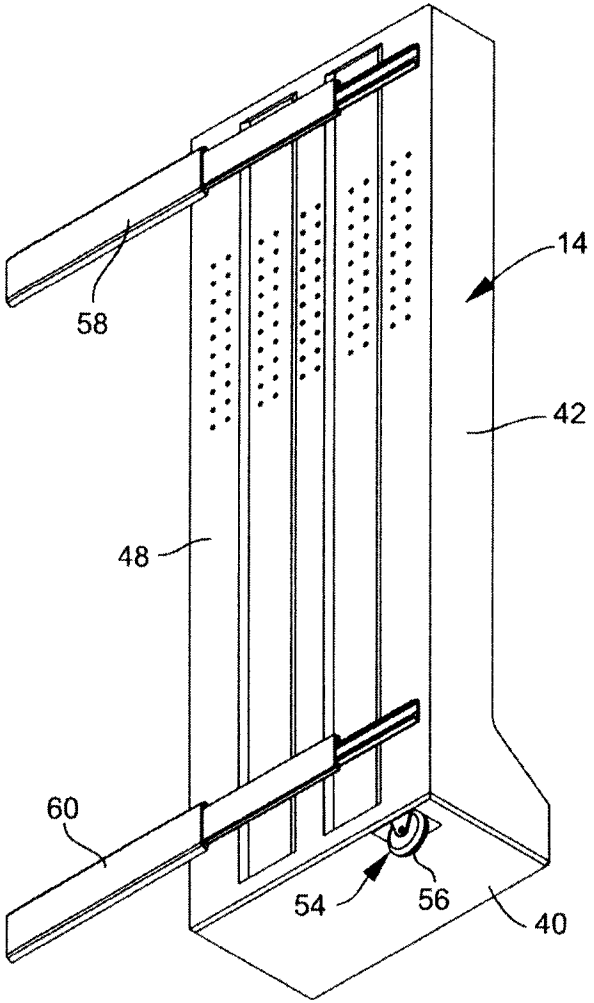
FIG. 12 is a perspective view from a bottom left viewpoint of the left drawer of the gun cabinet of FIG. 1.
Figure 17:
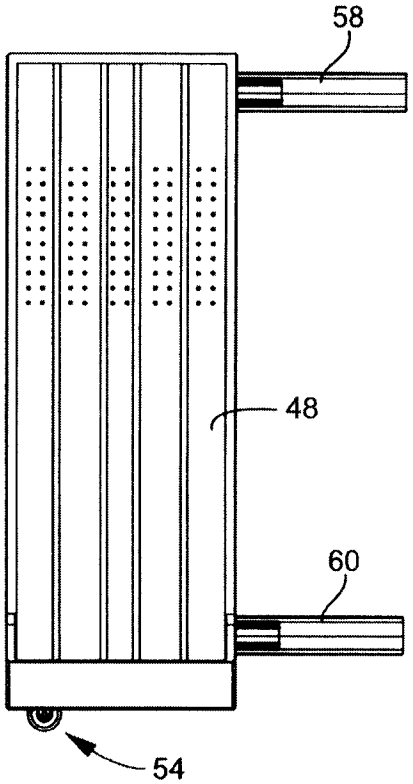
FIG. 17 is a right side elevation the left drawer of the gun cabinet of FIG. 1.
Figure 16:
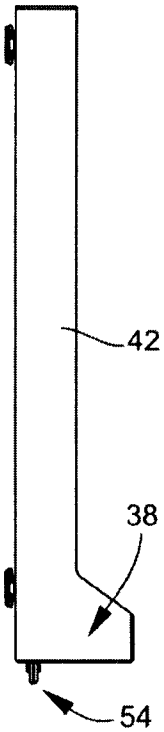
FIG. 16 is a front elevation of the left drawer of the gun cabinet of FIG. 1.
Figure 15:
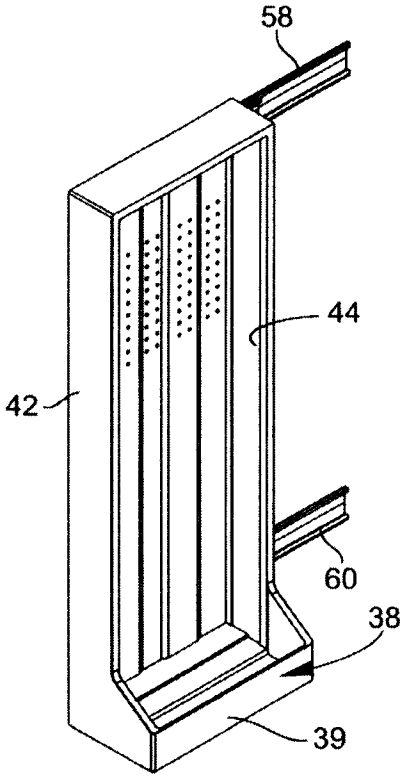
FIG. 15 is a perspective view from a top right viewpoint of the left drawer of the gun cabinet of FIG. 1.
Figure 14:
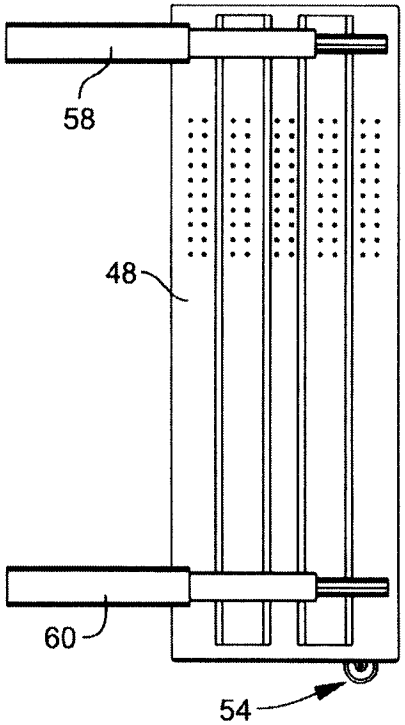
FIG. 14 is a left elevation of the left drawer of the gun cabinet of FIG. 1.

As best shown in FIG. 6, the pair of tall vertical side walls 42 of drawer 14 and and tall vertical side wall 57 of drawer 16 define a space 62 therebetween for storage shelves 36. Storage shelves 36 can also include a shelf 64 above drawers 14 and 16. Additional storage is provided by pockets 61 on door 28.

It will be appreciated by those skilled in the art that the present invention is subject to modification and variation. For example, it will be appreciated by those skilled in the art that while gun cabinet 10 preferably has two drawers, it can be modified to have only one drawer or modified to have more than two drawers. It is intended that such modifications and variations are considered to be within the broad scope of the invention which is intended to be limited only by the following claims.

What is claimed is:

1. A gun cabinet in combination with a plurality of long guns, wherein the gun cabinet comprises an enclosure having a top wall, a bottom wall, a back wall, a pair of side walls and a door, said enclosure having a hollow interior space and a first drawer within said space, wherein the long guns are stored within said first drawer, said first drawer having a base with a wheel adapted to support said base on an associated floor and a vertically extending side wall with a pair of spaced apart slidable support members attached to said vertically extending side wall of said first drawer and one of said side walls of said enclosure, wherein said pair of slidable support members each move between an extended position and a retracted position to move said first drawer in and out of said enclosure, wherein a through slot is formed in the bottom wall and said wheel is received in the through slot when the first drawer is stored within the enclosure.

2. A gun cabinet in combination with a plurality of long guns as in claim 1, wherein said wheel is a caster wheel mounted on said base.

3. A gun cabinet in combination with a plurality of long guns as in claim 1, wherein said cabinet has a second drawer.

4. A gun cabinet in combination with a plurality of long guns as in claim 1, wherein said cabinet has a second drawer which is a mirror image of said first drawer.

5. A gun cabinet in combination with a plurality of long guns as in claim 1, wherein said first drawer has a forwardly facing wall with a sidewardly extending foot.

6. A gun cabinet in combination with a plurality of long guns, said gun cabinet comprising:

an enclosure having a top wall, a bottom wall with a slot therethrough, a back wall, a pair of side walls, and a door, said enclosure having a hollow interior space; wherein a first drawer and a second drawer are stored within said space; wherein corresponding long guns are stored in each of the first and second drawers;

each of said first and second drawers having:

a base with a caster wheel adapted to support said base on an associated floor, a forwardly facing wall, and a vertically extending side wall with a pair of slidable support members;

wherein a corresponding first pair of slidable support members are attached to said vertically extending side wall of said first drawer and a first side wall from said side walls of said enclosure, wherein a corresponding second pair of slidable support members are attached to said vertically extending side wall of said second drawer and a second side wall from said side walls of said enclosure; wherein at least one of said caster wheels is received within the slot of the bottom wall of the enclosure.

7. A gun cabinet in combination with a plurality of long guns, the gun cabinet having:

an enclosure having a top wall, a bottom wall with a pair of through slots therein, a back wall, a pair of side walls, and a door, said enclosure having a hollow interior space and a pair of drawers within said space;

each of said drawers having:

a base with a caster wheel adapted to support base on an associated floor, a forwardly facing wall, and a vertically extending side wall with a pair of slidable support members each attached to said vertically extending side wall and one of said side walls of said enclosure;

wherein each caster wheel of each drawer is received within a corresponding through slot from said pair of through slots in the bottom wall of the enclosure.

* * * * *